US008355653B2

(12) United States Patent
Toba et al.

(10) Patent No.: US 8,355,653 B2
(45) Date of Patent: Jan. 15, 2013

(54) DEVELOPMENT CARTRIDGE

(75) Inventors: Shinjiro Toba, Yokohama (JP); Tetsushi Uneme, Susono (JP)

(73) Assignee: Canon Kabushiki Kaisha, Tokyo (JP)

( * ) Notice: Subject to any disclaimer, the term of this patent is extended or adjusted under 35 U.S.C. 154(b) by 283 days.

(21) Appl. No.: 12/912,597

(22) Filed: Oct. 26, 2010

(65) Prior Publication Data

US 2011/0103834 A1 May 5, 2011

(30) Foreign Application Priority Data

Oct. 30, 2009 (JP) ..... 2009-250151

(51) Int. Cl.
*G03G 15/04* (2006.01)

(52) U.S. Cl. ..... 399/119; 399/227
(58) Field of Classification Search ..... 399/119, 399/227
See application file for complete search history.

(56) References Cited

U.S. PATENT DOCUMENTS 5,631,726 A 5/1997 Sawada

FOREIGN PATENT DOCUMENTS

JP 07-304233 A 11/1995

*Primary Examiner* — Walter L Lindsay, Jr.
*Assistant Examiner* — Barnabas Fekete
(74) *Attorney, Agent, or Firm* — Canon USA Inc IP Division

(57) ABSTRACT

A cartridge attachable to and detachable from an image forming apparatus main body includes a rotating member, a supporting member configured to rotatably support the rotating member, a regulating portion configured to abut against an end surface of the rotating member in a rotational axis direction to regulate movement in the rotational axis direction, a hole portion configured to expose a portion of the end surface so as to enable a contact portion provided on the image forming apparatus main body to contact the end surface, a concave portion configured to retain grease, and a wall surface in the concave portion located at a downstream side in a rotation direction and provided such that an area of the wall surface that is farther from the hole portion than an area thereof that is closer to the hole portion is located at the downstream side of the rotation direction.

5 Claims, 11 Drawing Sheets

DEVELOPMENT CARTRIDGE

BACKGROUND OF THE INVENTION

1. Field of the Invention

The present invention relates to a cartridge provided with a rotating member, and attachable to and detachable from an electrophotographic image forming apparatus (hereinafter, referred to as an image forming apparatus).

A development cartridge includes at least a developer bearing member (hereinafter, simply referred to as "developing roller"), and is attachable to and detachable from the image forming apparatus main body.

A process cartridge is formed by integrating an image bearing member and, at least a charging unit and a developing unit into a single cartridge, and is attachable to and detachable from the image forming apparatus main body 2. Description of the Related Art There are some image forming apparatuses such as a copying machine, a printer, and a facsimile, in which a development cartridge or a process cartridge is attachable thereto and detachable therefrom. A developing unit included in the development cartridge or the process cartridge develops an electrostatic latent image formed on a surface of an image bearing member and visualizes the image as a toner image. At this point, the development cartridge is configured by integrating a developing roller for developing an electrostatic latent image formed on the image bearing member, a toner storing unit for storing developer (hereinafter, simply referred to as "toner"), and a developing blade for regulating thickness of a toner layer on the developing roller into a single cartridge. Then, the development cartridge is configured to be attachable to and detachable from the image forming apparatus main body. On the other hand, the process cartridge is configured by integrating an image bearing member such as a photosensitive drum, a developing roller for developing an electrostatic latent image formed on the image bearing member, and a toner storing unit for storing toner into a single cartridge. Then, the process cartridge is configured to be attachable to and detachable from the image forming apparatus main body Each of the development cartridge and the process cartridge is provided with a developing roller, and a developing roller supporting member for rotatably supporting the developing roller from both end portions of the developing roller. In particular, in order to rotate such the developing roller smoothly on the developing roller supporting member, the invention relating to a grease groove formed on a shaft portion, which is discussed in Japanese Patent Application Laid-Open No. 07-304233 (especially in FIG. 7) can be applied. The invention discussed in Japanese Patent Application Laid-Open No. 07-304233 itself (especially in FIG. 7) is relates to a configuration in which a grease groove is formed on a shaft portion formed on a drive cover, grease is applied to the grease groove, and a gear is attached to the shaft portion. With such configuration, sliding resistance in the shaft portion and the gear is reduced.

It is assumed that the developing roller is rotatably mounted on the developing roller supporting member. Then, it is assumed that the developing roller supporting member includes bearing portions in both end portions in a longitudinal direction, which receives both end portions of a shaft of the developing roller, and regulates a position of the developing roller in a shaft direction. If the invention of Japanese Patent Application Laid-Open No. 07-304233 described above may be applied to this configuration, for example, grease is applied to the grease grooves formed on the bearing portions, and a shaft portion of the developing roller is mounted on the bearing portions. With such configuration, sliding resistance between surfaces of the developing roller and inner side surfaces of the bearing portions is reduced (see FIGS. 10A to 10C of the present application).

However, in the configuration in which the above described developing roller (hereinafter, may be sometimes referred to as "rotating member") is mounted on the developing roller supporting members, there is a risk, in the mounting process, that grease in the grooves and its surrounding may move to end surfaces of the shaft portions of the developing roller, thus making them dirty.

In particular, if a through-hole is formed on the bearing portion, and the end surface of the shaft portion of the developing roller is exposed, a possibility that a user may touch the end surface of the shaft portion of the developing roller seems to be high (see FIGS. 10A to 10C). In such case, when grease adheres to the end surface of the shaft portion of the developing roller, there is a risk that the user may touch the grease, which adheres to the user's hand. In order not to make the user's hand dirty with the grease, first of all, it is conceivable that the bearing portion is constituted of a bag-shaped hole so that the grease may not squeeze out to the outside. However, with this configuration, it is impossible to expose the end portion of the shaft portion of the developing roller and to bring it into contact with an electric terminal of a power supply unit. In order not to make the user's hand dirty with the grease, secondly, it is also conceivable to perform strict coating management of the grease so that the grease may not squeeze out. However, this configuration results in increase of product costs.

SUMMARY OF THE INVENTION

The present invention is directed to a cartridge capable of preventing a user's hand from being soiled with grease, if the grease reaches an end surface of a shaft portion of a rotating member.

According to an aspect of the present invention, a cartridge attachable to and detachable from an image forming apparatus main body includes a rotating member configured to rotate upon receiving a driving force from the image forming apparatus main body, a supporting member configured to rotatably support the rotating member, a regulating portion provided on the supporting member, and configured to abut against an end surface of the rotating member in a rotational axis direction to regulate movement of the rotating member in the rotational axis direction, a hole portion provided in the supporting member and adjacent to the regulating portion, the hole portion exposing a portion of the end surface so as to enable a contact portion provided on the image forming apparatus main body to contact the end surface, a concave portion provided on the supporting member adjacent to the regulating portion, and configured to retain grease, and a wall surface in the concave portion located at a downstream side of the rotating member in a rotation direction thereof, and provided such that an area of the wall surface that is farther from the hole portion than an area thereof that is closer to the hole portion is located at the downstream side of the rotation direction.

Further features and aspects of the present invention will become apparent from the following detailed description of exemplary embodiments with reference to the attached drawings.

BRIEF DESCRIPTION OF THE DRAWINGS

The accompanying drawings, which are incorporated in and constitute a part of the specification, illustrate exemplary embodiments, features, and aspects of the invention and, together with the description, serve to explain the principles of the invention.

DESCRIPTION OF THE EMBODIMENTS

Various exemplary embodiments, features, and aspects of the invention will be described in detail below with reference to the drawings.

However, dimensions, materials, shapes, their relative positions and the like of components described in the exemplary embodiment are changed as appropriate depending on configuration or various conditions of an apparatus to which the present invention is applied. Therefore, unless otherwise specifically described, the scope of the present invention is not intended to limit only to these items described in the exemplary embodiment.

Figure 1A:
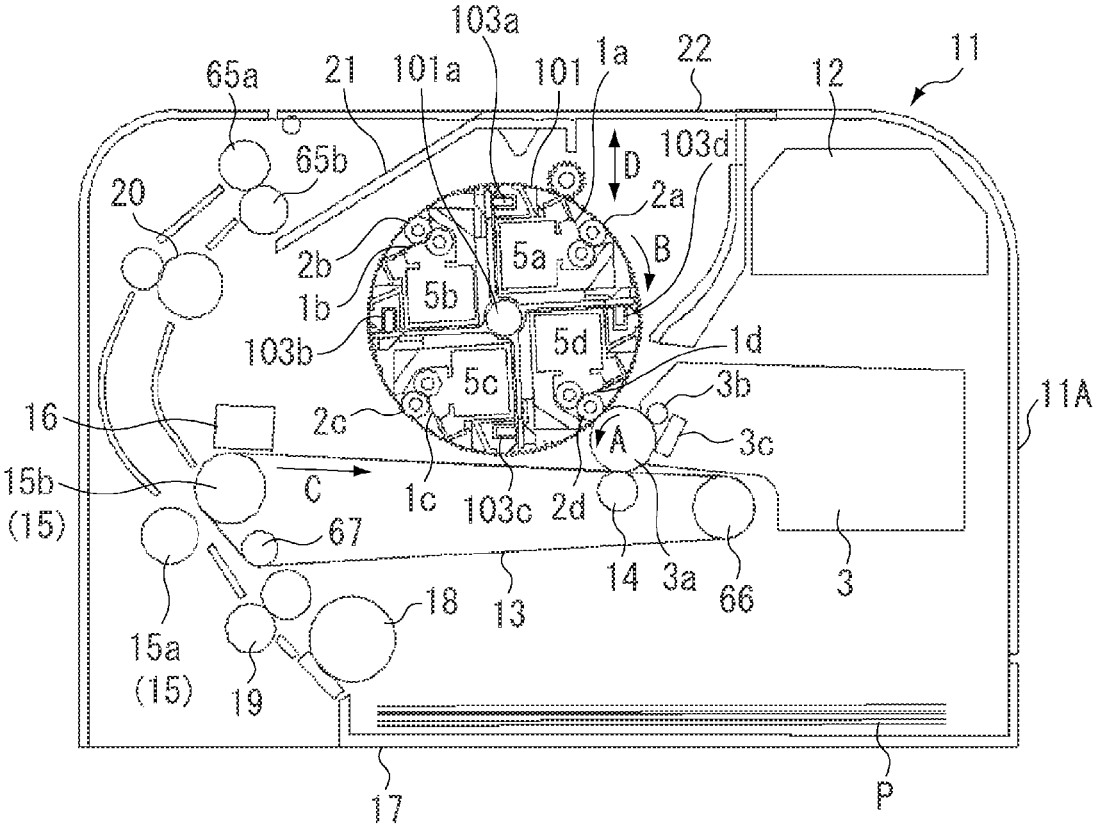
FIGS. 1A and 1B are cross-sectional views illustrating a configuration of an image forming apparatus according to an exemplary embodiment of the present invention.

FIG. 1A is a cross-sectional view illustrating a configuration of an image forming apparatus 11 according to an exemplary embodiment of the present invention. The image forming apparatus 11 employs an electrophotographic image formation process, and is a laser beam printer for 4-full colors. As illustrated in FIG. 1A, the image forming apparatus 11 includes an image forming apparatus main body (hereinafter, simply referred to as "apparatus main body") 11A. Inside the apparatus main body 11A, there is provided an "image forming unit" for forming an image. The "image forming unit" includes a photosensitive drum 3*a* serving as an "image bearing member", a primary transfer roller 14 serving as a "transfer device" and so forth.

The image forming apparatus 11 is provided with the photosensitive drum 3*a*. Around the photosensitive drum 3*a*, there are arranged a charging roller 3*b* serving as a "charging unit" for charging uniformly the photosensitive drum 3*a*, and an exposure device 12 serving as an "exposure unit" for irradiating the photosensitive drum 3*a* with laser light to form a latent image thereon. Further, around the photosensitive drum 3*a*, there is arranged either one of a yellow development cartridge 5*a*, a magenta development cartridge 5*b*, a cyan development cartridge 5*c*, and a black development cartridge 5*d* for developing the latent image formed on the photosensitive drum 3*a* using a toner of corresponding color. Moreover, around the photosensitive drum 3*a*, there is arranged a cleaning device 3*c* serving as a "cleaning unit" for removing residual toner on the photosensitive drum 3*a*.

Now, a drum cartridge 3 configured by integrating the photosensitive drum 3*a*, the charging roller 3*b*, and the cleaning device 3*c* into a single unit, and attachable to and detachable from the image forming apparatus 11 will be described. The photosensitive drum 3*a*, the charging roller 3*a*, and the cleaning device 3*c* may be independently configured, or may be integrally configured.

The yellow development cartridge 5*a*, the magenta development cartridge 5*b*, the cyan development cartridge 5*c*, and the black development cartridge 5*d* are held by a rotary 101 rotatably mounted to the apparatus main body 11A. The yellow development cartridge 5*a*, the magenta development cartridge 5*b*, the cyan development cartridge 5*c*, and the black development cartridge 5*d* may be also fixed type developing devices which are fixed to the rotary 101. In the present exemplary embodiment, a development cartridge system is adopted, in which the yellow development cartridge 5*a*, the magenta development cartridge 5*b*, the cyan development cartridge 5*c*, and the black development cartridge 5*d* are attachable to and detachable from the rotary 101 of the apparatus main body 11A.

Configurations in which the rotary 101 holds each of the yellow development cartridge 5*a*, the magenta development cartridge 5*b*, the cyan development cartridge 5*c*, and the black development cartridge 5*d* are all similar to one another. Therefore, the yellow development cartridge 5*a* is described as an example of the configurations in which the rotary 101 in the present exemplary embodiment holds each of the yellow development cartridge 5*a*, the magenta development cartridge 5*b*, the cyan development cartridge 5*c*, and the black development cartridge 5*d*. Reference numerals 1*a* to 1*d* in FIG. 1A correspond to developing blades 1*a* to 1*d* described below.

An operation of the image formation will be described below. First, the photosensitive drum 3*a* rotates in an arrow "A" direction. In synchronization with the rotation of the photosensitive drum 3*a*, an intermediate transfer belt 13 rotates in an arrow "C" direction. Then, the charging roller 3*b* charges uniformly a surface of the photosensitive drum 3*a*, and an exposure device 12 serving as an "exposure unit" irradiates the surface of the photosensitive drum 3*a* with a light for a yellow image, and a yellow electrostatic latent image is formed on the photosensitive drum 3*a*.

Figure 1B:
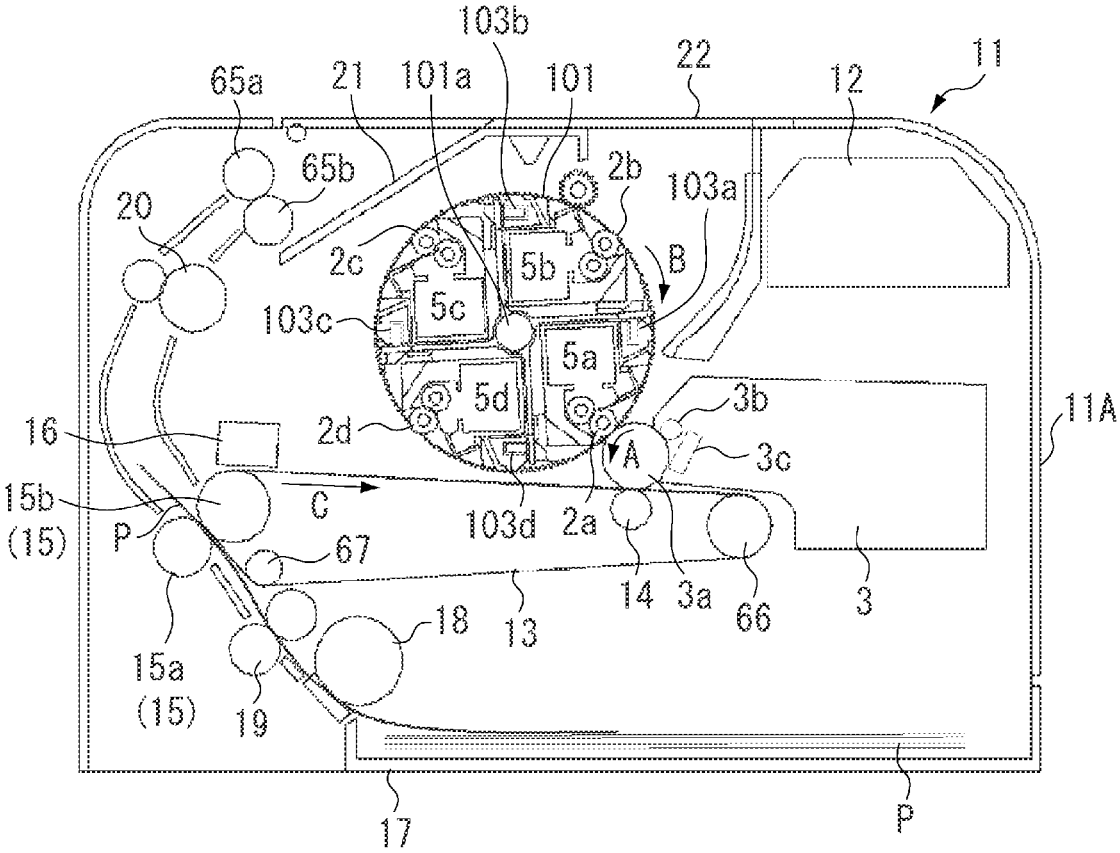

The yellow development cartridge 5*a* is attached to the rotary 101. A latched portion 9*b*11 (see FIG. 3B) provided on the yellow development cartridge 5*a* engages with a latching member 103*a* (see FIG. 3B) for latching the yellow development cartridge 5*a* illustrated in FIGS. 1A and 1B provided in the rotary 101. Further, a latched portion 9*a*11 (see FIG. 3A) engages with a latching member 104*a* (see FIG. 3A), so that the yellow development cartridge 5*a* can be prevented from popping up from the rotary 101. Further, the latching member 103*a* engages with the yellow development cartridge 5*a* by a spring (not illustrated) to regulate a movement in an arrow "D" direction. Similar latched portions are also provided in the magenta development cartridge 5*b*, the cyan development cartridge 5*c*, and the black development cartridge 5*d*, respectively. Then, each of the latched portions engages with latching members 103*b*, 103*c*, 103*d*, 104*b*, 104*c*, and 104*d* (see FIGS. 3A and 3B) provided in the rotary 101, so that the pop-up from the rotary 101 is prevented.

FIG. 1B is a cross-sectional view illustrating a driving step of the image forming apparatus 11. A position of the yellow development cartridge 5*a* during formation of an electrostatic latent image is located at a downstream side in the rotation direction of the rotary 101 from a position illustrated in FIG. 1A, and at an upstream side in the rotation direction from a position illustrated in FIG. 1B.

As described above, the rotary 101 can rotate, concurrently with formation of the above described electrostatic latent image, while holding the yellow development cartridge 5*a*, the magenta development cartridge 5*b*, the cyan development cartridge 5*c*, and the black development cartridge 5*d*. The rotary 101 rotates in an arrow "B" direction about a rotary rotation shaft 101*a* by a drive transmission mechanism provided in the image forming apparatus 11. Accordingly, the rotary 101 rotates, and as illustrated in FIG. 1B, the yellow development cartridge 5*a* is arranged at a development position facing the photosensitive drum 3*a*.

Then, an electric potential difference is generated between the photosensitive drum 3*a* and the developing roller 2*a*, so that yellow developer adheres to the latent image formed on the photosensitive drum 3*a*. Thus, development is carried out by causing the yellow developer to adhere onto the latent image formed on the photosensitive drum 3*a*. Accordingly, a yellow developer image is formed on the photosensitive drum 3*a*.

After that, voltage having a reversed polarity to that of the toner is applied to the primary transfer roller 14 arranged on an inner side of the intermediate transfer belt 13, and a yellow toner image on the photosensitive drum 3*a* is primarily transferred onto the intermediate transfer belt 13.

Upon completion of the primary transfer of the yellow toner image described above, the rotary 101 receives a driving force from the driving transmission mechanism of the image forming apparatus 11, and further rotationally moves in the arrow "B" direction. Then, the magenta development cartridge 5*b*, the cyan development cartridge 5*c*, and the black development cartridge 5*d* are positioned in sequence at the development positions facing the photosensitive drum 3*a*. Similar to the development of the yellow toner image, formation, development, primary transfer of electrostatic latent images for respective colors of magenta, cyan and black are performed in sequence, and toner images of these four colors are superposed on the intermediate transfer belt 13.

On the inner side of the intermediate transfer belt 13, there are arranged the above described primary transfer roller 14, an secondary transfer inner roller 15*b* serving as a "conveyance unit" for conveying a sheet P which is a "recording medium", and rollers 66 and 67. While the toner images are superposed, a secondary transfer roller 15*a* serving as the "conveyance unit" for conveying the sheet P is arranged in a state non-contact with the intermediate transfer belt 13. In addition, a cleaning unit 16 of the intermediate transfer belt 13 is arranged in a state non-contact with the intermediate transfer belt 13.

On the other hand, the sheet P serving as a member on which the toner image is transferred is stored in stack in a sheet feeding cassette 17 provided in a lower part of the apparatus main body 11A. The sheets P are separated and fed one by one from the sheet feeding cassette 17 by a feed roller 18 serving as the "conveyance unit", and are fed to a conveyance roller 19 serving as the "conveyance unit". The conveyance roller 19 feeds out the fed sheet P between the intermediate transfer belt 13 and the secondary transfer roller 15*a*. In this process, as illustrated in FIG. 1B, the secondary transfer roller 15*a* is brought into press contact with the intermediate transfer belt 13. Then, the sheet P can be sandwiched by the secondary transfer roller pair 15.

Moreover, voltage having a reversed polarity to that of the toner is applied to the secondary transfer roller 15*a*, and the above described toner images of four colors superposed on the intermediate transfer belt 13 are secondarily transferred onto a surface of the conveyed sheet P. The sheet P onto which the toner images have been transferred is forwarded to a fixing device 20. In the fixing device 20, the sheet P is heated and pressed, and the toner images are fixed onto the sheet P. Thus, the image is formed on the sheet P. Then, the sheet P is discharged from the fixing device 20 via discharge rollers 65*a* and 65*b* serving as a "discharging unit" to a sheet discharge and conveyance unit 21 provided outside the image forming apparatus 11.

Figure 2A:
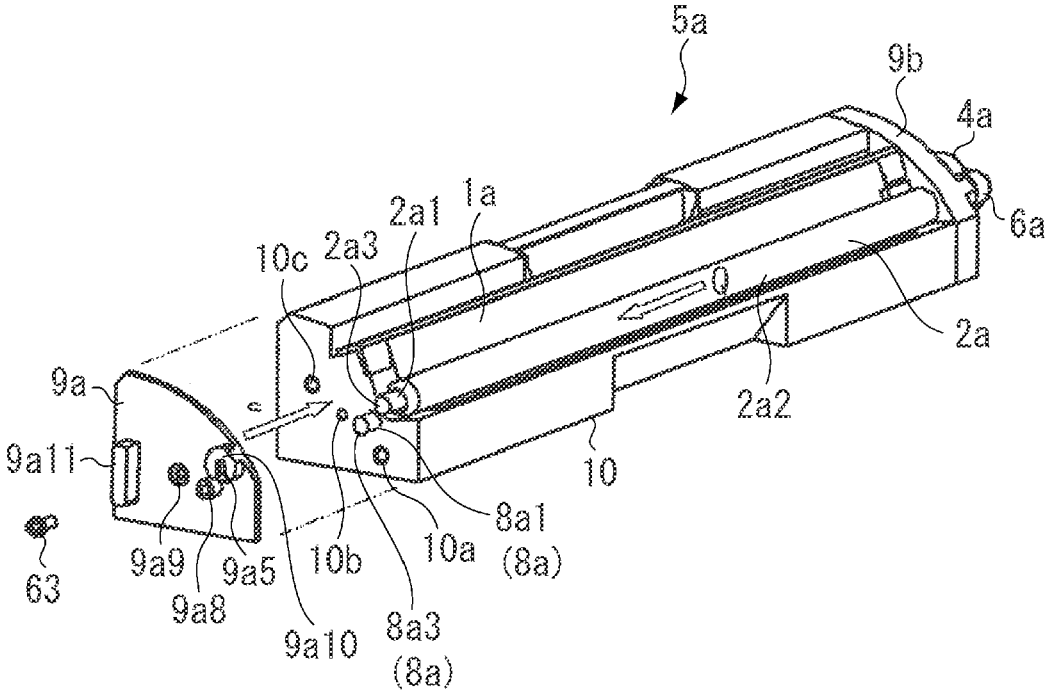
FIGS. 2A and 2B are partly exploded perspective views illustrating a configuration of a yellow development cartridge.
Figure 2B:
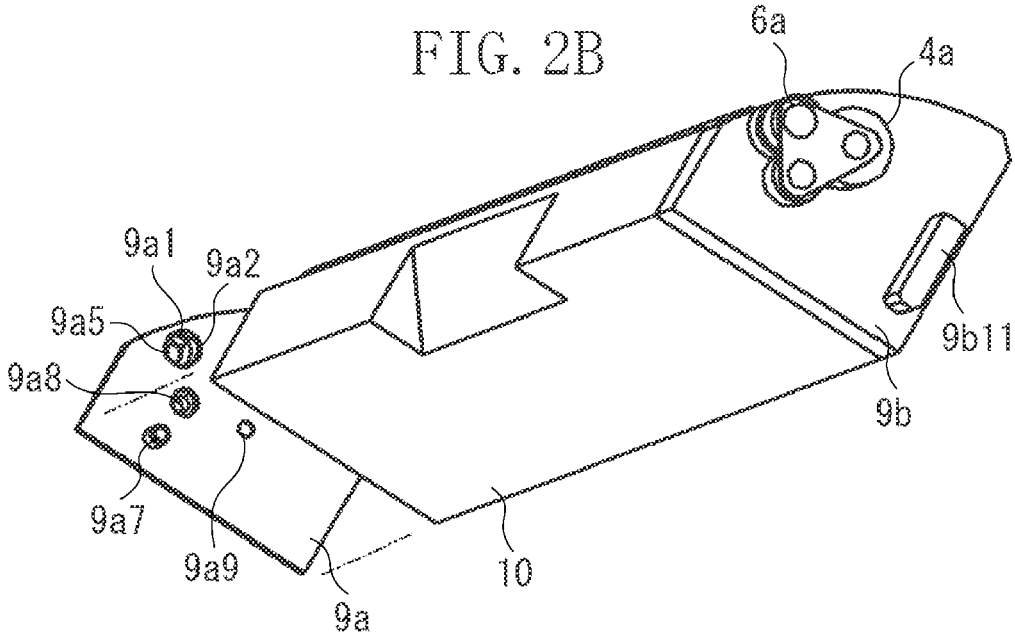

FIG. 2A is a partially exploded perspective view illustrating a configuration of the yellow development cartridge 5*a*. FIG. 2B is a perspective view illustrating a configuration of the yellow development cartridge 5*a*. Hereinbelow, configuration of the yellow development cartridge 5*a* will be described, but configurations of the magenta development cartridge 5*b*, the cyan development cartridge 5*c*, and the black development cartridge 5*d* are also similar thereto. As illustrated in FIG. 2A, the yellow development cartridge 5*a* is provided with a development container 10. Inside the development container 10, a developing roller 2*a* which extends in a longitudinal direction of the development container 10 and a toner supply roller 8*a* are rotatably mounted. At both end portions in the longitudinal direction of the development container 10, developing roller bearings 9*a* and 9*b* are mounted.

On the developing roller bearing 9*a*, there is formed the latched portion 9*a*11 which engages with the latching member 104*a* of the rotary 101. Further, on the developing roller bearing 9*b*, there is formed the latched portion 9*b*11 which engages with the latching member 103*a* of the rotary 101. Therefore, pop-up of the yellow development cartridge 5*a* from the rotary 101 can be prevented. The latching member 103*a* (see FIG. 1A) engages with the yellow development cartridge 5*a* by a spring (not illustrated) to regulate a movement in the arrow "D" direction in FIG. 1A. Further, the magenta development cartridge 5*b*, the cyan development cartridge 5*c*, and the black development cartridge 5*d* are provided with the latched portions respectively. Then, these latched portions engage with the latching members 103*b*, 103*c*, and 103*d* provided in the rotary 101 respectively, so that the pop-up from the rotary 101 can be prevented.

The developing roller 2*a* serving as a "rotating member" is provided with a rigid shaft 2*a*1, and a rubber roll portion 2*a*2 formed around the rigid shaft 2*a*1. More specifically, the rigid shaft 2*a*1 penetrates the rubber roll portion 2*a*2 in a direction along a rotation shaft of the developing roller 2*a*, and both ends of the rigid shaft 2*a*1 protrude from the rubber roll portion 2*a*2. Then, as described above, the developing roller 2*a* serving as the "rotating member" functions as a "developer bearing member" which can develop an electrostatic latent image formed on the photosensitive drum 3*a* serving as the "image bearing member".

A toner supply roller 8*a* (see FIG. 4B) is provided with a rigid shaft 8*a*1, and a sponge roller portion 8*a*2 (see FIG. 4B) formed around the rigid shaft 8*a*1. More specifically, the rigid shaft 8*a*1 penetrates the sponge roller portion 8*a*2 in the direction along a rotation shaft of the toner supply roller 8*a*, and both ends of the rigid shaft 8*a*1 protrude from the sponge roller portion 8*a*2. Then, the toner supply roller 8*a* serving as the "rotating member" functions as a "developer supply roller" for supplying developer to the developing roller 2*a* which can develop an electrostatic latent image formed on the photosensitive drum 3*a*.

Holes 10*c* and 10*a* are formed in the development container 10, and bosses (not illustrated) are formed in the developing roller bearing (the supporting member) 9*a*. The bosses (not illustrated) are inserted and fit into the holes 10*c* and 10*a*, and the developing roller bearing 9*a* is positioned with respect to the development container 10. Behind the developing roller bearing 9*a*, a screw 63 is fastened to a hole 9*a*9 of the developing roller bearing 9*a* and a screw hole 10*b* of the development container 10 to integrally fix them. Further, an opposite developing roller bearing (the supporting member) 9*b* is also fixed to the development container 10 in a similar way.

Figure 3A:
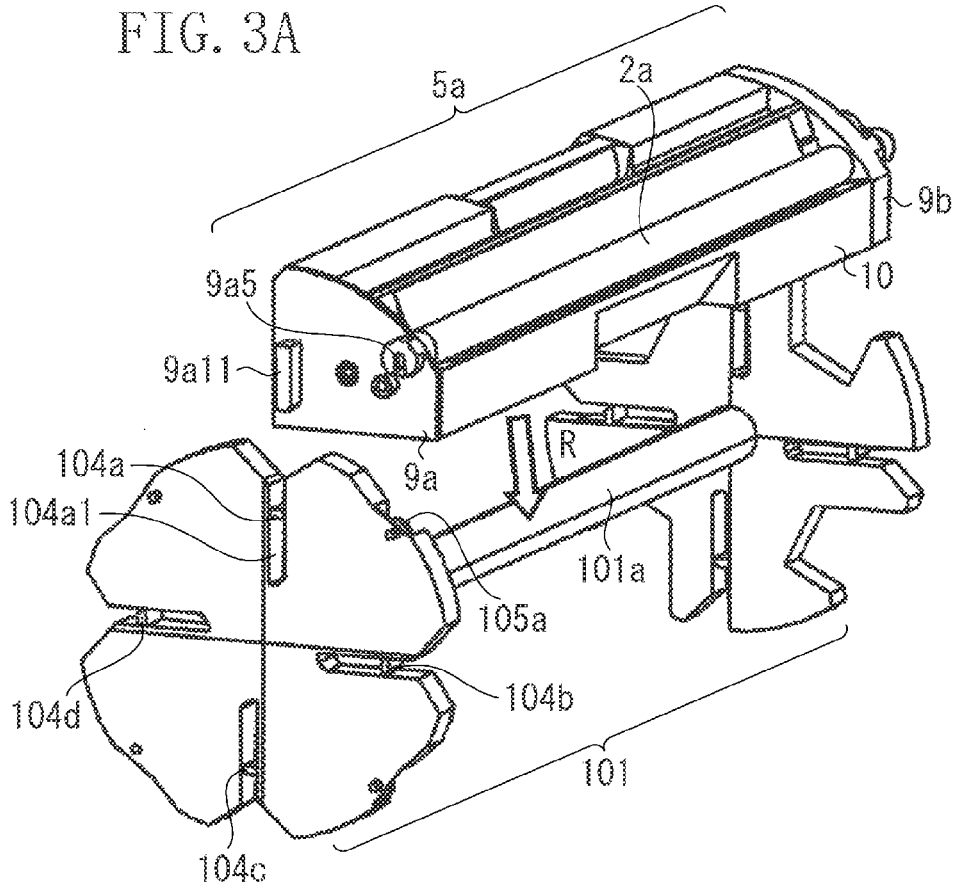
FIGS. 3A and 3B are partly exploded perspective views illustrating a mounting step of a rotary and the yellow development cartridge.
Figure 3B:
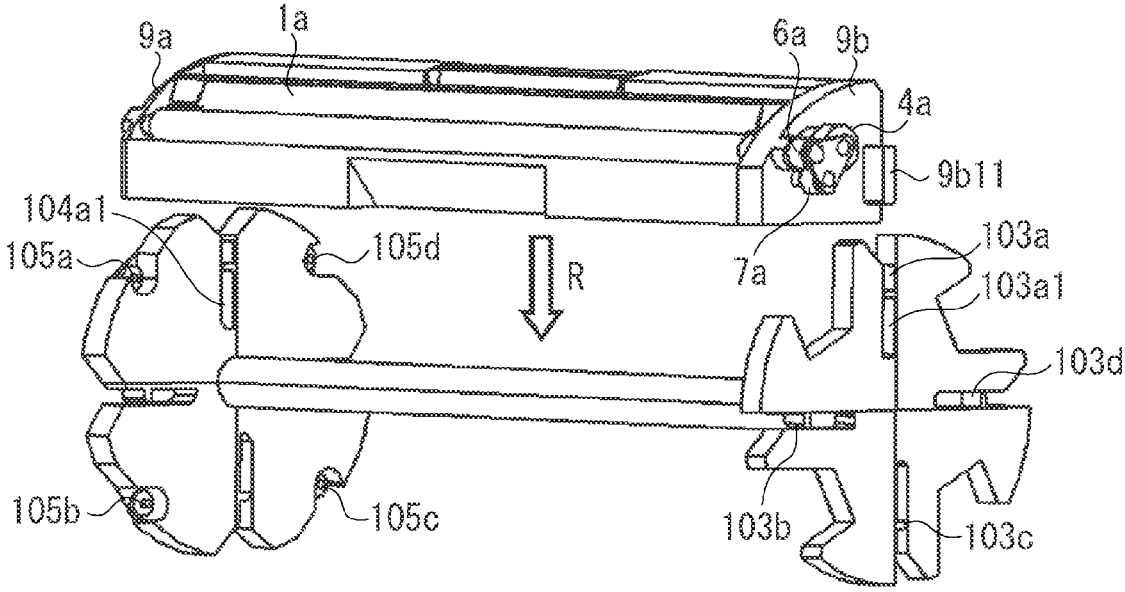

FIG. 3A is a partially exploded perspective view illustrating mounting steps of the rotary 101 and the yellow development cartridge 5*a*. FIG. 3B a partially exploded perspective view illustrating the mounting steps of the rotary 101 and the yellow development cartridge 5*a*, which is viewed from another angle. As illustrated in FIGS. 3A and 3B, the yellow development cartridge 5*a* is attached in an arrow "R" direction, so that the latched portions 9*a*11 and 9*b*11 engage with a slit portion 104*a*1 and a slit portion 103*a*1 of the rotary 101. Materials of the developing roller bearings 9*a* and 9*b* are molded with polyacetal resin. The developing roller 2*a* is rotatably supported by the developing roller bearings (the supporting members) 9*a* and 9*b*.

As illustrated in FIG. 3B, the yellow development cartridge 5*a* is configured to receive a developing bias via an electric contact (contact portion) 105*a* provided inside the rotary 101 which is provided inside the apparatus main body 11A. In other words, a through-hole (hole portion) 9*a*5 is notched and opened in a direction orthogonal to the rigid shaft 2*a*1 (vertically downward direction) of the developing roller 2*a*. Thus, a portion of an end surface of the rigid shaft is exposed from the hole portion. Then, when the through-hole (hole portion) 9*a*5 receives the electric contact 105*a* of the apparatus main body 11A, an end surface 2*a*3 which is an "end portion" of the rigid shaft 2*a*1 of the developing roller 2*a* becomes contactable with the electric contact 105*a*, and a bias is applied to the end surface 2*a*3 (see FIG. 2A) of the developing roller 2*a*.

Figure 4A:
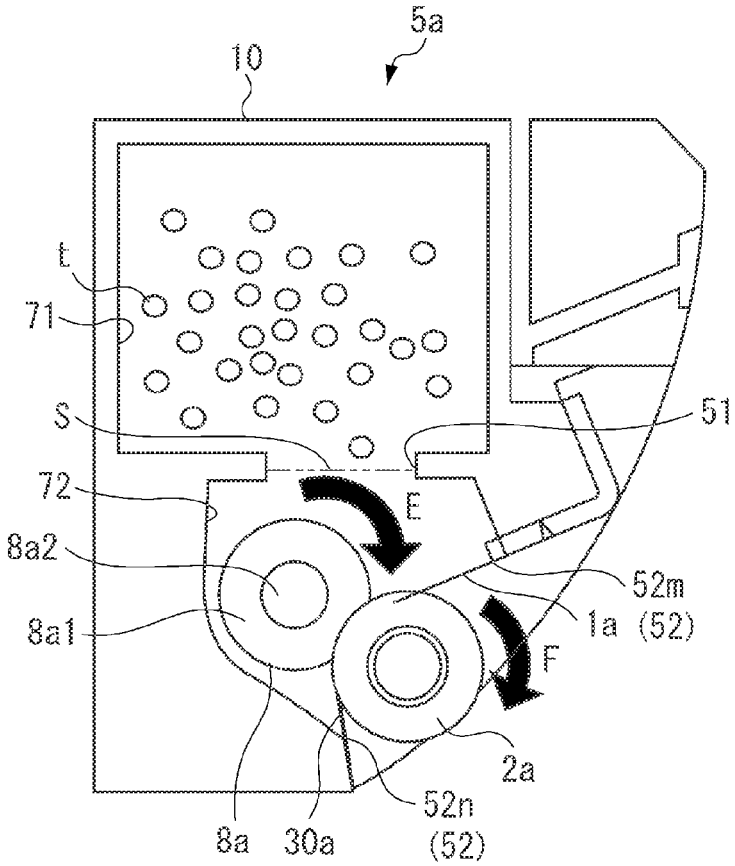
FIGS. 4A and 4B are cross-sectional views illustrating a configuration of the yellow development cartridge.

FIG. 4*a* is a cross-sectional view illustrating a configuration of the yellow development cartridge 5*a*. As illustrated in FIG. 4A, the development container 10 of the yellow development cartridge 5*a* is provided with a first chamber 71 and a second chamber 72. Between the first chamber 71 and the second chamber 72, a through-hole 51 is formed, and a toner "t" contained in the first chamber 71 can move to the second chamber 72. However, in a case where the yellow development cartridge 5*a* is a new product, a toner sealing member S is attached in advance between the first chamber 71 and the second chamber 72, and flow of the toner from the first chamber 71 to the second chamber 72 is prevented. When the toner sealing member S is removed prior to use, the toner can flow from the first chamber 71 to the second chamber 72. An opening 52 is formed in the second chamber 72. A developing blade 1*a* extending toward the developing roller 2*a* is mounted on a side of an upper edge portion 52*m* of the opening 52. Further, an elastic seat member 30*a* extending toward the developing roller 2*a* is mounted on a side of a lower edge portion 52*n* of the opening 52. The toner supply roller 8*a* is arranged on an inner side of the opening 52 inside the second chamber 72. The developing roller 2*a* is arranged in the opening 52.

Toner "t" is supplied to the development container 10. The toner "t" contained in the first chamber 71 moves to the second chamber 72. The toner "t" is supplied to the toner supply roller 8*a*, and when the toner supply roller 8*a* rotates in an arrow "E" direction, the toner "t" is supplied to the developing roller 2*a*. The developing roller 2*a* receives a driving force from the apparatus main body 11A with an input gear 4*a* (see FIG. 2B), and the driving force is transmitted from the input gear 4*a* to a helical gear 6*a* (see FIG. 3B) arranged on the same shaft as the rotation shaft of the developing roller 2*a*. Then, the developing roller 2*a* rotates in an arrow "F" direction in FIG. 4A, and the toner "t" on the developing roller 2*a* is developed onto the photosensitive drum 3*a*, while being regulated by the developing blade 1*a*. The toner "t" remaining on the developing roller 2*a* after development is removed by the toner supply roller 8*a*. After that, the toner is again supplied by the toner supply roller 8*a* to the developing roller 2*a*. In order to provide an electric potential difference relative to the photosensitive drum 3*a* on the developing roller 2*a*, voltage is supplied from the image forming apparatus 11 via the through-hole 9*a*5, which is a notched portion of the developing roller bearing 9*a*, to the end surface 2*a*3 of the rigid shaft 2*a*1 of the developing roller 2*a* at the electric contact 105*a* (see FIG. 3B).

Figure 4B:
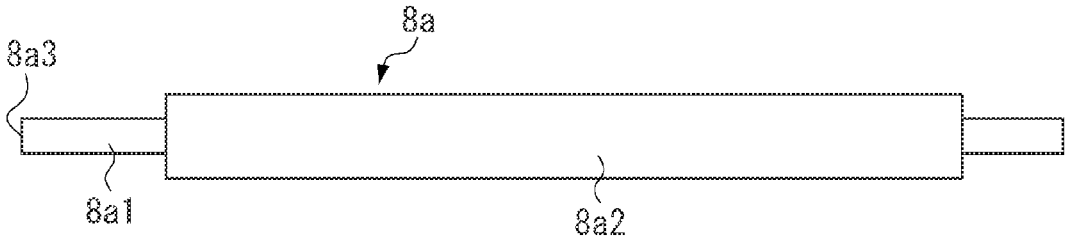

FIG. 4B is a perspective view illustrating a configuration of the toner supply roller 8*a*. As illustrated in FIG. 4B, the toner supply roller 8*a* is provided with a rigid shaft 8*a*1, and a sponge roller portion 8*a*2 formed around the rigid shaft 8*a*1. Regarding the toner supply roller 8*a*, similar to the developing roller 2*a*, voltage is supplied from the image forming apparatus 11 by causing a contact (not illustrated) to contact with an end surface 8*a*3 of the rigid shaft 8*a*1 via a hole 9*a*8.

In the development position, in order to cause the developing roller 2*a* to stably abut against the photosensitive drum 3*a*, the entire rotary 101 with which the yellow development cartridge 5*a* is held is urged in a direction of the photosensitive drum 3*a*. Thus, the developing roller 2*a* of the yellow development cartridge 5*a* becomes to abut against the photosensitive drum 3*a* by a predetermined applied pressure.

Figure 5:
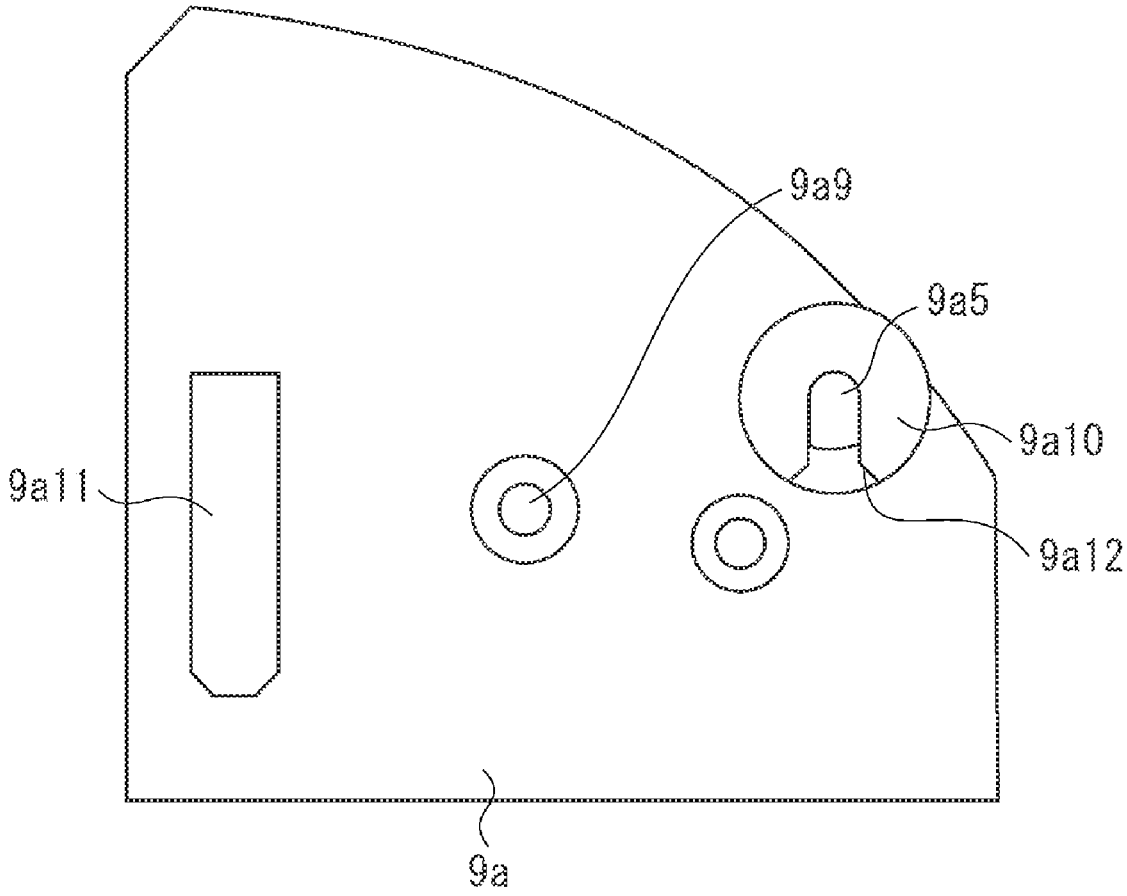
FIG. 5 is a side view illustrating a configuration of a developing roller bearing.

FIG. 5 is a side view illustrating a configuration of the developing roller bearing 9*a*. As illustrated in FIG. 5, the developing roller bearing 9*a* has a receiving convex portion 9*a*10 with a convex-shaped cross-section which receives the end portion of the developing roller 2*a*. The inverse U shaped through-hole 9*a*5 is formed in the receiving convex portion 9*a*10. Therefore, the receiving convex portion 9*a*10 is formed to be opened downward from the center. This configuration enables an electric contact via which a developing bias is supplied from the apparatus main body 11A to contact with the end surface 2*a*3 on the rigid shaft 2*a*1 of the developing roller 2*a*. More specifically, when the yellow development cartridge 5*a* is attached in the arrow "R" direction in FIGS. 3A and 3B, in order that the electric contact 105*a* can abut against the end surface 2*a*3 of the developing roller 2*a*, this configuration is provided not to hinder movement of the electric contact 105*a* along with attachment and detachment. The rigid shaft 2*a*1 serving as a cored bar of the developing roller 2*a* is molded with, a material of, for example, SUM.

Figure 6B:
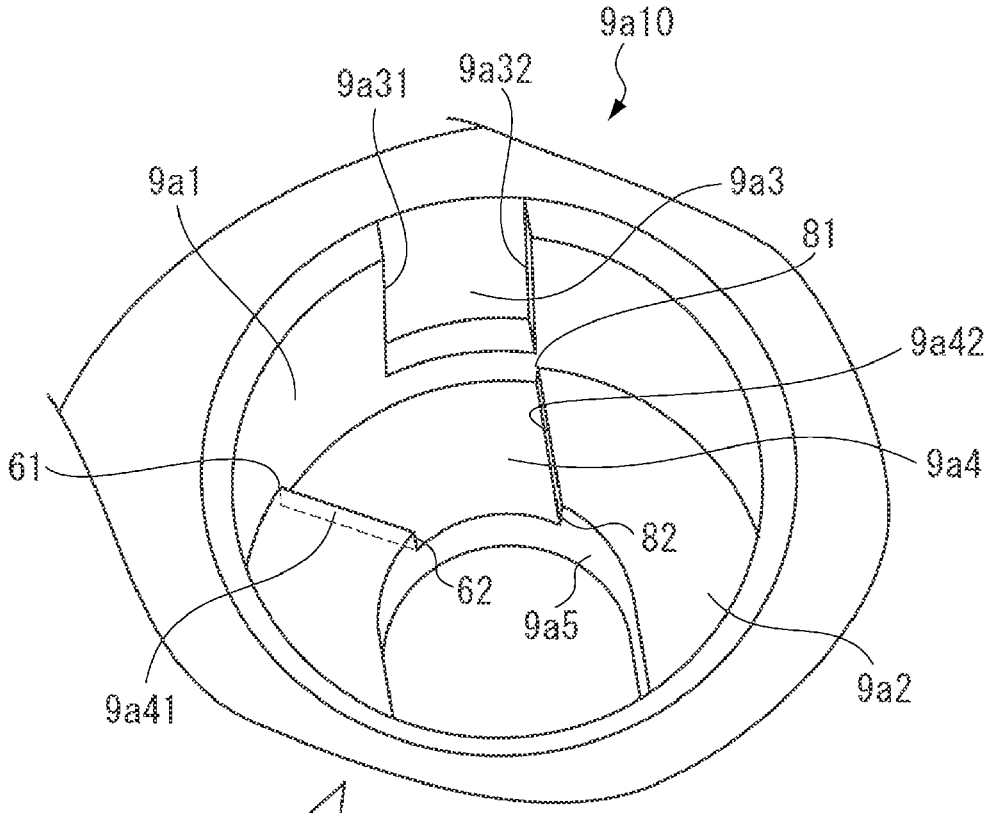
FIGS. 6A and 6B are rear views illustrating a configuration of the developing roller bearing.
Figure 6A:
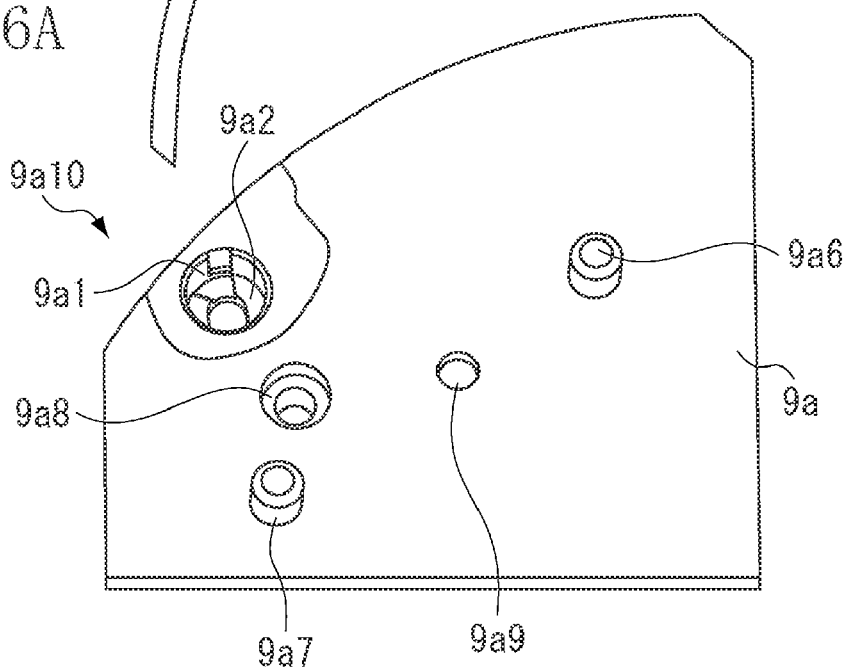

FIG. 6A is a rear view illustrating a configuration of the developing roller bearing 9*a*. Before the configuration of the rear side of the developing roller bearing 9*a* is described in detail, a mechanism of movement of the developing roller 2*a* in a shaft direction will be described. As described above, the helical gear 6*a* is integrally mounted on the rigid shaft 2*a*1 of the developing roller 2*a* (see FIGS. 2A and 2B). Then, an angle of the helical gear 6*a* is set so that the developing roller 2*a* is urged in a direction orthogonal to the rotation direction of the developing roller 2*a* (in an arrow "Q" direction in a longitudinal direction of the developing roller 2*a* illustrated in FIG. 2A) by a rotation of the input gear 4*a* during image formation.

For this purpose, the receiving convex portion 9*a*10 of the developing roller bearing 9*a* includes an end surface sliding surface 9*a*2 illustrated in FIG. 2B and FIGS. 6A and 6B, at a rear surface side, for receiving an urging force of the above described helical gear 6*a*. The end surface 2*a*3 of the rigid shaft 2*a*1 abuts on the end surface sliding surface 9*a*2, and thus a position of the developing roller 2*a* in the longitudinal direction is determined.

As illustrated in FIG. 6A, on the rear surface of the developing roller bearing 9*a*, there are formed the above described receiving convex portion 9*a*10, a hole 9*a*8, a hole 9*a*9, a boss 9*a*6, and a boss 9*a*7. In the present exemplary embodiment, grease serving as lubricant is applied to a sliding portion of the rigid shaft 2*a*1 of the developing roller 2*a* and the developing roller bearing 9*a*. The grease is applied to reduce sliding resistance of the sliding portion of the developing roller bearing 9*a*, and to achieve prevention of shaving of a circumferential surface sliding surface 9*a*1 (surface in a radial direction) and an end surface sliding surface 9*a*2 (surface in a longitudinal direction) and stabilization of rotational accuracy.

Assembly process of the developing roller bearing 9*a* includes applying grease on a hole side of the developing roller bearing 9*a*, and causing the developing roller bearing 9*a* to move in the "A" arrow direction illustrated in FIG. 2A. Then, the positioning boss 9*a*6 and the positioning boss 9*a*7 (see FIGS. 2B and 6A) provided on the developing roller bearing 9*a* side are fitted into the hole 10*c* and the hole 10*a* (see FIG. 2A) provided on the development container 10 side, and the developing roller bearing 9*a* and the development container 10 are firmly secured with a screw 63.

FIG. 6B is an enlarged perspective view illustrating a configuration of the receiving convex portion 9*a*10. The receiving convex portion 9*a*10 has a concave shape as viewed from the rear surface side of the developing roller bearing 9*a*. The receiving convex portion 9*a*10 includes the end surface sliding surface 9*a*2 serving as a "regulating portion" for regulating the movement of the developing roller 2*a* in the rotation shaft direction on a bottom surface side in the concave shape, and includes the circumferential surface sliding surface 9*a*1 on a side surface of the concave shape. The through-hole (hole portion) 9*a*5 which penetrates in the rotation shaft direction of the developing roller 2*a* is formed in the center and adjacent to the end surface sliding surface 9*a*2. Further, an end surface side grease groove 9*a*4 serving as a "concave portion" which is concave in the rotation shaft direction of the developing roller 2*a* is formed adjacent to the end surface sliding surface 9*a*2. A circumferential surface side grease groove 9*a*3 is formed on the circumferential surface sliding surface 9*a*1. According to the above described configuration, the developing roller bearing 9*a* serving as the "supporting member" for rotatably supporting the developing roller 2*a* is configured.

Figure 7A:
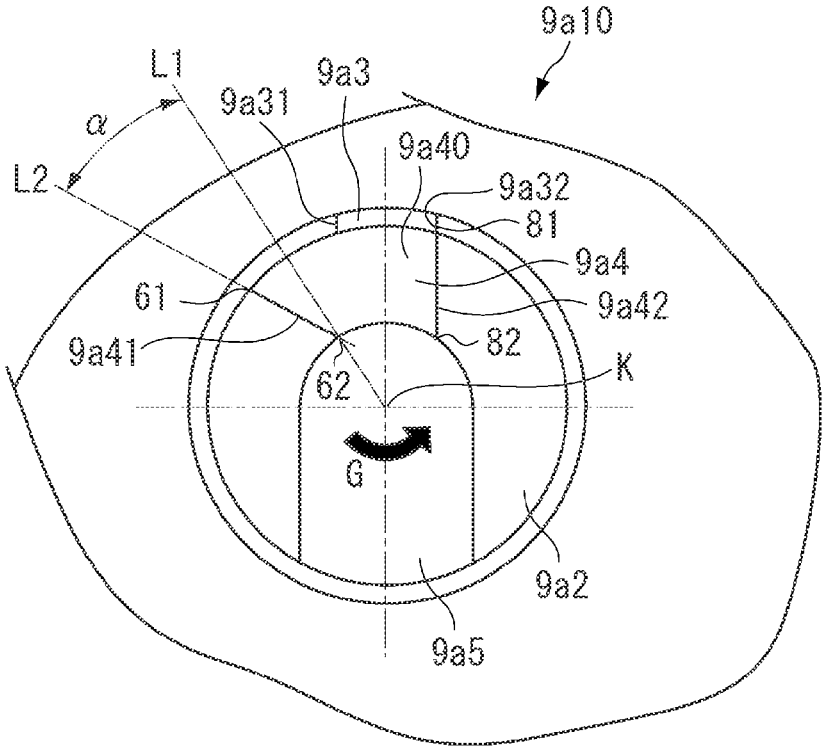
FIGS. 7A and 7B are enlarged rear views illustrating a configuration of an end surface sliding surface.

FIG. 7A is an enlarged rear view illustrating a configuration of the receiving convex portion 9*a*10. As illustrated in FIG. 7A, the end surface side grease groove 9*a*4 is formed on the end surface sliding surface 9*a*2. The end surface side grease groove 9*a*4 has a concave shape further deeper than the end surface sliding surface 9*a*2, as viewed from the rear surface side. Further, the end surface side grease groove 9*a*4 includes a plane 9*a*40, a downstream side wall surface 9*a*41 which is grouped into a downstream side of the rotation shaft direction of the developing roller 2*a*, and an upstream side wall surface 9*a*42 which is grouped into an upstream side of the rotation direction of the developing roller 2*a*.

With respect to the downstream side wall surface 9*a*41 and the upstream side wall surface 9*a*42, the one which is located farther than the other one from a center of rotation K is formed more inclined in the identical direction side to a rotation direction G of the developing roller 2*a* relative to a virtual plane L1 extending in a radius direction from the center of rotation K of the developing roller 2*a*. Then, if a plane along the downstream side wall surface 9*a*41 is taken as a virtual plane L2, an angle α formed by the virtual plane L2 and the virtual plane L1 is set to a predetermined angle.

More specifically, a far area 61 which is an area farther from the center of rotation K of the through-hole 9*a*5 of the downstream side wall surface 9*a*41 is located with a difference in the rotation direction of the developing roller 2*a* from a close area 62 which is an area nearer to the center of rotation K of the through-hole 9*a*5. In other words, the area 61 which is farther from the hole portion than the area 62 is provided to a position at the downstream side of the rotation direction. The downstream side wall surface 9*a*41 is located on the virtual plane L2 connecting the far area 61, the area farther from the through-hole 9*a*5, and the close area 62, the area nearer to the through-hole 9*a*5, with a minimum distance.

If a plane passing through the close area 62 and extending in the radius direction of the developing roller 2*a* is taken as the virtual plane L1, the downstream side wall surface 9*a*41 is a plane inclined at a predetermined angle relative to the virtual plane L1. The end surface side grease groove 9*a*4 and the through-hole 9*a*5 are adjacent to each other in a direction orthogonal to the rigid shaft 2*a*1 of the developing roller 2*a*. In a similar way, a far area 81 which is an area farther from the center of rotation K of the through-hole 9*a*5 of the upstream side wall surface 9*a*42 is located with a difference in the rotation direction of the developing roller 2*a* from a close area 82 which is an area nearer to the center of rotation K of the through-hole 9*a*5. Here, the upstream side wall surface 9*a*42 extends in the vertical direction.

In the circumferential surface side grease groove 9*a*3, the downstream side wall surface 9*a*31 is formed at the downstream side of the rotation direction of the developing roller 2*a*, and the upstream side wall surface 9*a*32 is formed at the upstream side of the rotation direction of the developing roller 2*a*. Further, the upstream side wall surface 9*a*32 of the circumferential surface side grease groove 9*a*3, and the upstream side wall surface 9*a*42 of the end surface side grease groove 9*a*4, as illustrated in FIG. 7A, are aligned in a direction orthogonal to the rigid shaft 2*a*1 of the developing roller 2*a*. As compared with the downstream side wall surface 9*a*31, the downstream side wall surface 9*a*41 is arranged at the downstream side in the rotation direction of the developing roller 2*a*.

Figure 8A:
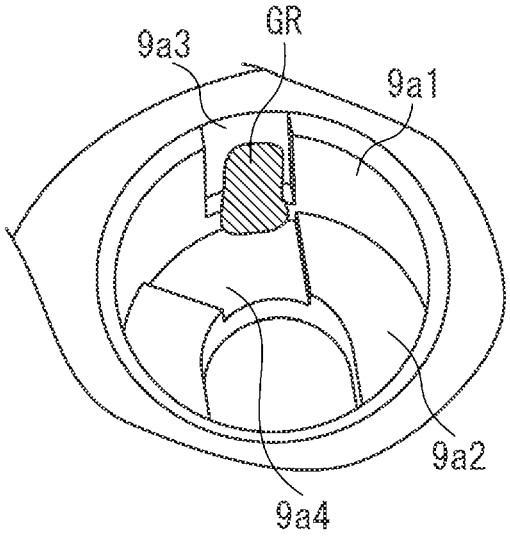
FIGS. 8A to 8D illustrate movement steps of grease which accumulates in a circumferential surface side grease groove and an end surface side grease groove.

FIG. 8A is a process diagram illustrating a state in which grease GR accumulates in the circumferential surface side grease groove 9*a*3. As illustrated in FIG. 8A, in a case where the grease GR is applied between the side surface of the developing roller 2*a* and the circumferential surface sliding surface 9*a*1 of the developing roller bearing 9*a*, at first, the grease GR accumulates in the circumferential surface side grease groove 9*a*3.

Figure 8B:
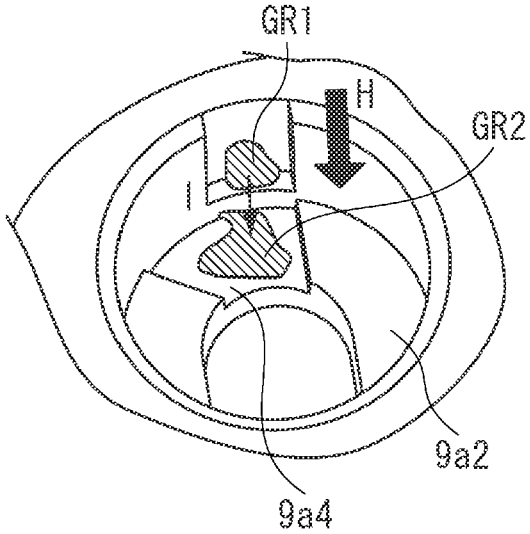

FIG. 8B is a process diagram illustrating a process in which the grease GR moves from the circumferential surface side grease groove 9*a*3 to the end surface side grease groove 9*a*4. As illustrated in FIG. 8B, the grease GR moves gradually from the circumferential surface side grease groove 9*a*3 to the end surface side grease groove 9*a*4 by the rotation and axial movement of the developing roller 2*a*.

Figure 8C:
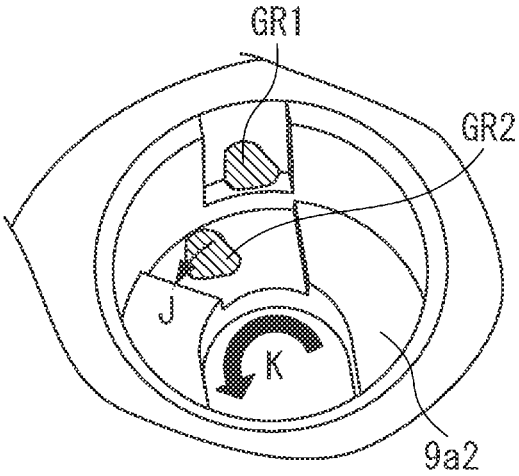

FIG. 8C is a process diagram illustrating a process in which the grease GR which accumulates in the end surface side grease groove 9*a*4 moves from the upstream side to the downstream side in the rotation direction of the developing roller 2*a*. As illustrated in FIG. 8C, the grease GR moves from the upstream side to the downstream side in the rotation direction of the developing roller 2*a*, inside the end surface side grease groove 9*a*4 by the rotation and the axial movement of the developing roller 2*a*.

Figure 8D:
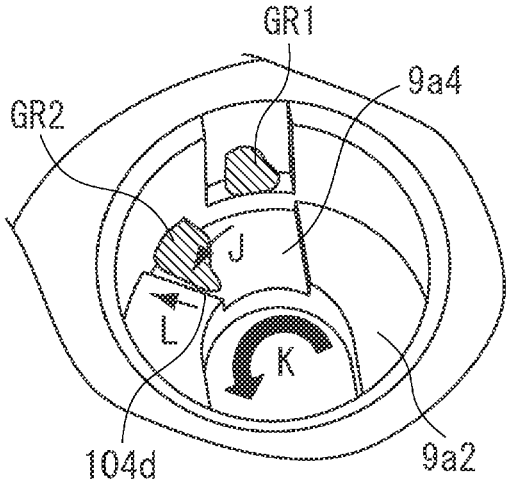

FIG. 8D is a process diagram illustrating a process in which the grease GR which gets close to the downstream side wall surface 9*a*41 moves from the upstream side to the downstream side in the rotation direction of the developing roller 2*a*, and moves from the center of rotation K to the radius direction. As illustrated in FIG. 8D, the grease GR moves farther away in the radius direction of the developing roller 2*a* inside the end surface side grease groove 9*a*4 by the rotation and the axial movement of the developing roller 2*a*.

According to such an action, even when the grease GR is divided into grease GR1 and grease GR2, the grease GR2 which gets close to the downstream side wall surface 9*a*41 is prevented from squeezing out from the through-hole 9*a*5 in a large amount. On the end surface sliding surface 9*a*2, there is provided the end surface side grease groove 9*a*4 with a concave shape for retaining the grease. The end surface side grease groove 9*a*4 can secure a capacity larger than a capacity which can retain the grease GR2 adhered to the end surface 2*a*3.

Figure 9A:
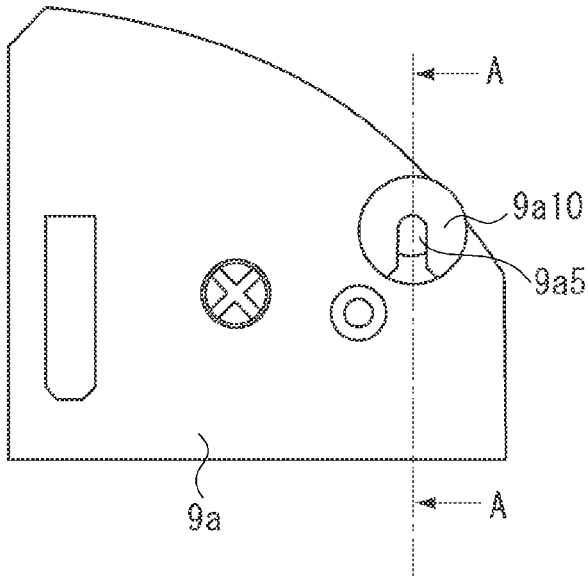
FIGS. 9A to 9C are side views and a front view illustrating a configuration of the developing roller bearing.
Figure 9B:
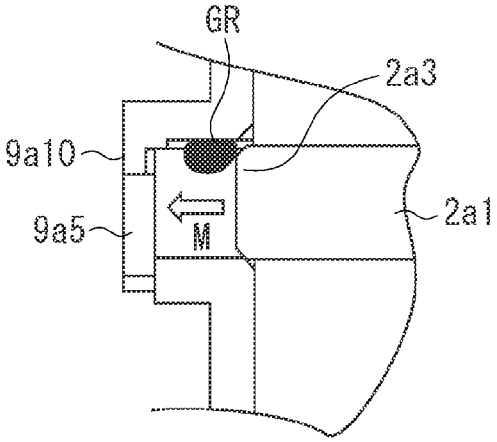
Figure 9C:
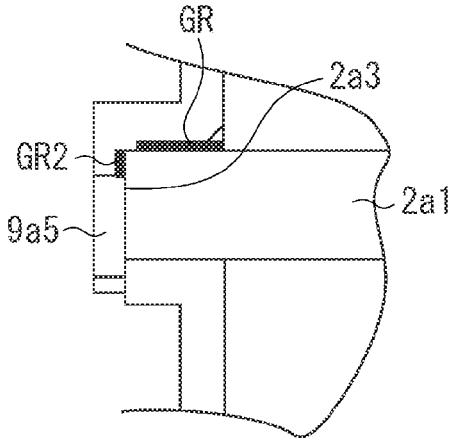

FIG. 9A is a front view illustrating a configuration of the developing roller bearing 9*a*. FIG. 9B is a cross-sectional view along an A-A line in FIG. 9A. FIG. 9*c* is a cross-sectional view along the A-A line in FIG. 9A. FIG. 9B illustrates a process in which the developing roller 2*a* moves in a leftward direction, and FIG. 9C illustrates a process in which the developing roller 2*a* has finished moving in the leftward direction.

As illustrated in FIGS. 9A and 9B, when the developing roller 2*a* is installed (inserted in an arrow "H" direction in FIG. 8B), the grease GR (see FIG. 8A) which has been applied in advance on the circumferential surface side grease groove 9*a*3 is scraped off by the tip of the developing roller 2. Then, the developing roller 2*a* moves toward the end surface side grease groove 9*a*4 (in an arrow "M" direction in FIG. 9B). Then, in a state in FIG. 9B, the grease GR moves in an arrow "J" direction (see FIG. 8C) which corresponds to the rotation direction of the developing roller 2*a* by the rotation of the developing roller 2*a*, and further moves in an arrow "L" direction (see FIG. 8D), which corresponds to an outward direction of the radius direction.

The angle $\alpha$ in FIG. 7 is set to 0° or more but not exceeding 180°, and a surface on which the grease GR does not move is formed in the through-hole 9*a*5. More specifically, since the grease GR moves in a direction away from the through-hole 9*a*5, adherence of the grease GR to the end surface 2*a*3 can be reduced to a small amount, and even when a user touches the through-hole 9*a*5, adherence of the grease GR to a user's hand can be prevented.

In the present exemplary embodiment, an example in which the present invention is applied to the developing roller bearing 9*a* of the developing roller 2*a* is described, but as another exemplary embodiment, the present invention can be applied to a bearing portion of the toner supply roller 8*a* and a bearing portion of the photosensitive drum 3*a*, and the like.

Further, in the present exemplary embodiment, a case in which the circumferential surface side grease groove 9*a*3 is provided is described, but even in a case in which the circumferential surface side grease groove 9*a*3 is not provided, similar effects can be obtained.

Figure 10A:
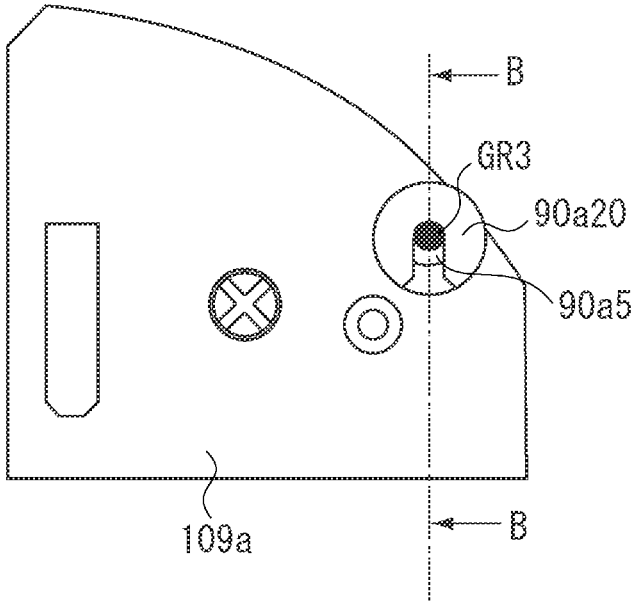
FIGS. 10A to 10C are side views and a front view illustrating a configuration of the developing roller bearing of a comparative example.
Figure 10B:
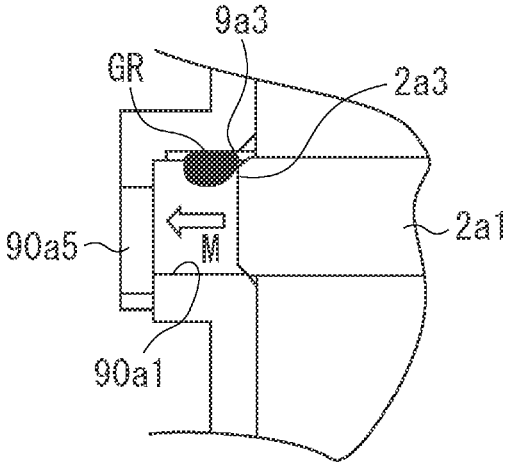
Figure 10C:
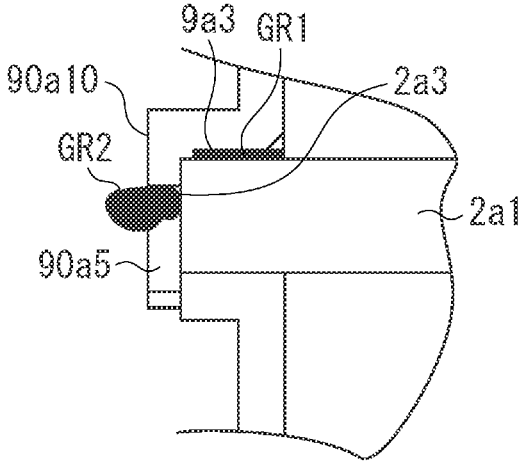

FIG. 10A is a front view illustrating a configuration of a developing roller bearing 109*a* of a comparative example (conventional example). FIG. 10B is a cross-sectional view along a B-B line in FIG. 10A. FIG. 10C is a cross-sectional view along the B-B line in FIG. 10A. FIG. 10B illustrates a process in which the developing roller 2*a* moves in the leftward direction, and FIG. 10C illustrates a process in which the developing roller 2*a* has finished moving in the leftward direction.

As illustrated in FIGS. 10A and 10B, when the developing roller 2*a* is installed, the developing roller 2*a* is inserted into a hole portion 90*a*1 of the developing roller bearing 109*a* while causing the rigid shaft 2*a*1 of the developing roller 2*a* to move in an arrow "M" direction. At this time, a portion of the grease GR applied in advance to the circumferential surface side grease groove 9*a*3 provided in the hole portion 90*a*1 is scraped off by the end surface 2*a*3 of the rigid shaft 2*a*1, and the grease GR is divided into the grease GR1 and the grease GR2. There was a concern about that the scraped-off grease GR2 loses its place to go, and finally passes through the hole 90*a*5, goes beyond the receiving convex portion 90*a*20, squeezes out, and reaches a location where the user may inadvertently touch it. According to the configuration of the development cartridge or the process cartridge of the present application, such a concern will be solved.

As described above, in the configuration according to the exemplary embodiments of the present invention, the developing roller 2*a* is smoothly supported by the developing roller bearing 9*a*. As a result, even when grease serving as a lubricant is applied between the side surface of the developing roller 2*a* and the developing roller bearing 9*a*, the grease is prevented from squeezing out from the through-hole 9*a*5. Accordingly, even when the grease GR reaches the end surface 2*a*3 of the rigid shaft 2*a*1 of the developing roller 2*a*, a user can avoid making his/her hand dirty, and the usability will be enhanced. Further, the application of the grease can be easily managed. Accordingly, an assembly cost can be reduced.

Further, with the yellow development cartridge 5*a* according to the exemplary embodiment, if a plane passing through the close area 62 and extending in a radius direction of the developing roller 2*a* is taken as the virtual plane L1, the downstream side wall surface 9*a*41 is a plane which is inclined at a predetermined angle relative to the virtual plane L1. Since the downstream side wall surface 9*a*41 is a plane, the end surface side grease groove 9*a*4 can be easily formed.

Moreover, with the yellow development cartridge 5*a* according to the exemplary embodiment, since the end surface side grease groove 9*a*4 and the through-hole 9*a*5 are adjacent to each other, a portion of the grease which has reached the end surface side grease groove 9*a*4 is allowed to reach the through-hole 9*a*5. When the electric contact 105*a* of the apparatus main body 11A comes into contact with the end surface 2*a*3 of the developing roller 2*a*, the grease which has reached the through-hole 9*a*5 exerts such a function as to create a good conduction of electricity.

Figure 7B:
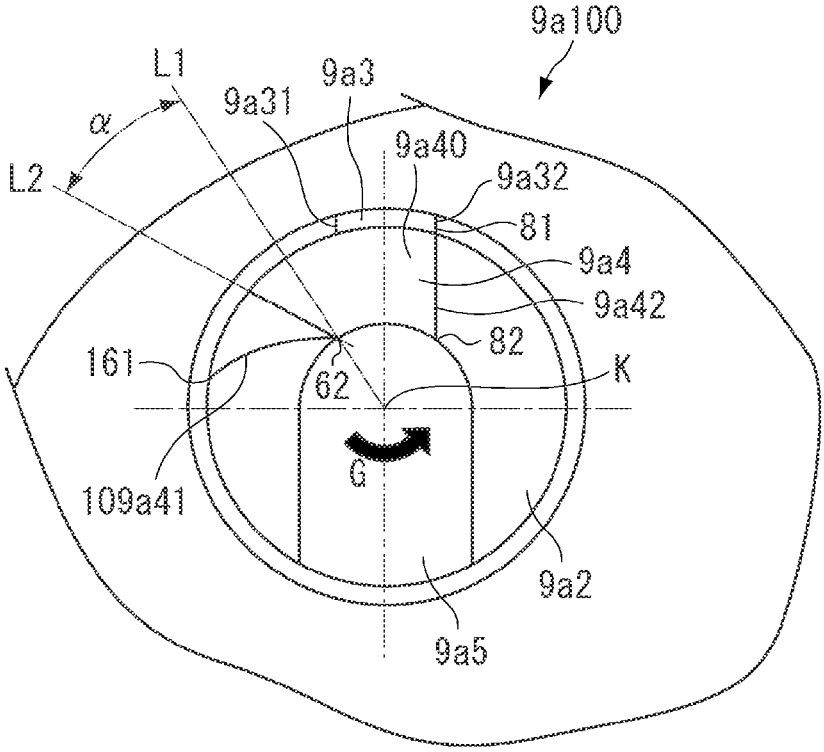

In the above described exemplary embodiments, the downstream side wall surface 9*a*41 is formed by a plane, but the present invention is not limited to this configuration. FIG. 7B is a rear view illustrating a configuration of the receiving convex portion 9*a*100 associated with a modified example. For example, as illustrated in FIG. 7B, the downstream side wall surface 109*a*41 may be a curved surface which has a shape convex toward the upstream side in the rotation direction of the rotating member. With such the configuration, the downstream side wall surface 109*a*41 is a curved surface (curved shape) which has an upward convex shape, it is difficult for the grease which has moved toward the far area 161 to move to the through-hole 9*a*5.

The exemplary embodiments have been described mainly concerning the yellow development cartridge 5*a*, however the present invention is not limited to this. In other words, the configuration of the embodiment can be applied to a process cartridge like a combination of a development cartridge such as the yellow development cartridge 5*a*, and a drum cartridge 3 including the photosensitive drum 3*a*.

The rotating member according to the present invention can be also applied to, for example, the charging roller serving as the charging unit. A cartridge in this case may include, for example, the above described drum cartridge provided with the above described charging roller. The supporting member, the regulating member, the hole portion, the convex portion, the wall surface, and the like in this case, can use the above described configuration according to the exemplary embodiments of the present invention.

While the present invention has been described with reference to exemplary embodiments, it is to be understood that the invention is not limited to the disclosed exemplary embodiments. The scope of the following claims is to be accorded the broadest interpretation so as to encompass all modifications, equivalent structures, and functions.

This application claims priority from Japanese Patent Application No. 2009-250151 filed Oct. 30, 2009, which is hereby incorporated by reference herein in its entirety.

What is claimed is:

1. A cartridge attachable to and detachable from an image forming apparatus main body, the cartridge comprising:

a rotating member configured to rotate upon receiving a driving force from the image forming apparatus main body;

a supporting member configured to rotatably support the rotating member;

a regulating portion provided on the supporting member, and configured to abut against an end surface of the rotating member in a rotational axis direction to regulate movement of the rotating member in the rotational axis direction;

a hole portion provided in the supporting member and adjacent to the regulating portion, the hole portion exposing a portion of the end surface so as to enable a contact portion provided on the image forming apparatus main body to contact the end surface;

a concave portion provided on the supporting member adjacent to the regulating portion, and configured to retain grease; and a wall surface in the concave portion located at a downstream side of the rotating member in a rotation direction thereof, and provided such that an area of the wall surface that is farther from the hole portion than an area thereof that is closer to the hole portion is located at the downstream side of the rotation direction.

2. The cartridge according to claim 1, wherein the wall surface is a plane provided to form a predetermined angle relative to a virtual plane passing through the rotational axis of the rotating member and the area closer to the hole portion.

3. The cartridge according to claim 1, wherein the wall surface has a curved shape which is convex toward an upstream side in the rotation direction of the rotating member.

4. The cartridge according to claim 1, wherein the rotating member is a developer bearing member that develops an electrostatic latent image formed on an image bearing member by a borne developer.

5. The cartridge according to claim 1, wherein the rotating member is a developer supply roller that supplies a developer to a developer bearing member which develops an electrostatic latent image formed on an image bearing member.

* * * * *